US006223486B1

(12) United States Patent
Dunham

(10) Patent No.: US 6,223,486 B1
(45) Date of Patent: May 1, 2001

(54) ADJUSTABLE CORNER TRIM STRIP

(75) Inventor: Wesley H. Dunham, Renton, WA (US)

(73) Assignee: Beadex Manufacturing Co., Inc., Auburn, WA (US)

( * ) Notice: Subject to any disclaimer, the term of this patent is extended or adjusted under 35 U.S.C. 154(b) by 0 days.

(21) Appl. No.: 09/481,057

(22) Filed: Jan. 11, 2000

(51) Int. Cl.[7] ..... E04B 1/00
(52) U.S. Cl. ..... 52/254; 52/255
(58) Field of Search ..... 52/255, 254, 256, 52/257

(56) References Cited

U.S. PATENT DOCUMENTS 1,804,564 * 5/1931 McChesney ..... 52/255
2,851,741 * 9/1958 Stemples ..... 52/255
3,109,207 * 11/1963 Cooper ..... 52/255
4,313,991 * 2/1982 Lamb ..... 52/255
4,863,774 * 9/1989 Tucker ..... 52/417
5,048,247 * 9/1991 Weldy ..... 52/255
5,442,886 * 8/1995 Iacobelli ..... 52/255
5,613,335 * 3/1997 Rennich ..... 52/254

* cited by examiner

*Primary Examiner*—Carl D. Friedman
*Assistant Examiner*—Kevin McDermott
(74) *Attorney, Agent, or Firm*—Seed IP Law Group PLLC

(57) ABSTRACT

A corner trim strip for drywall construction has a pair of parallel spaced core strips and a center bead bonded to a paper cover strip so that the trim strip has a center rib and is adjustable at the rib between obtuse and acute dihedral angles.

11 Claims, 2 Drawing Sheets

ADJUSTABLE CORNER TRIM STRIP

TECHNICAL FIELD

The present invention relates to corner trim strips for drywall construction, also commonly referred to as corner beads.

BACKGROUND OF THE INVENTION

In the drywall construction field two general types of corner trim strips have been commonly used, the "nail-on" type and the "tape-on" type. Nail-on beads commonly take the form of an angle strip of metal with side flanges meeting at a center corner rib providing shoulders against which spackle or joint cement can be dressed when feathered from the adjoining wall surfaces to cover the edges and outer faces of the side flanges and the heads of the nails or other fasteners securing these flanges to the wall structure. Tape-on trim strips typically utilize paper wings to secure a metal corner angle in position rather than using fasteners. These wings are lateral extensions of a paper cover strip which is bonded to the metal angle, usually on the outer faces of the side flanges. Spackle or joint cement for dressing the corner normally adhere significantly better to the paper cover strip of tape-on beads than to the exposed metal of nail-on beads.

U.S. Pat. No. 2,649,890 (Dunlap et al.) discloses a machine and method for making tape-on trim strips for drywall corners of the type comprising a vee-shaped metal core strip covered by a wider flexible tape extending as flexible wings beyond the longitudinal edges of the core strip. The core strip is described as being preferably between 0.015 and 0.020 gauge and the tape is indicated as preferably being a fairly heavy weight of kraft paper. Such a trim strip is shown and described in Australian Patent No. 153,625 (Dunlap), published May 22, 1952. As previously indicated, this is the type of reinforcing strip which has been widely commercially used as a tape-on corner reinforcing strip, except that for several years, the elbow portion of the metal core strip has been formed with a longitudinal rib covered with paper as shown, for example, in U.S. Pat. No. 5,131, 198. As in the case of typical nail-on corner trims, this paper over metal rib provides shoulders against which spackle or joint cement can be dressed when feathered from the adjacent wall surfaces over the paper covering the core strip. From time to time alternative tape-on corner reinforcing strips have been developed to be adjustable so as to also fit other than right-angle corners or to be lighter in weight or supposedly cheaper to produce.

For example, U.S. Pat. No. 2,862,264 (Perna) discloses an adjustable corner reinforcing unit for drywall corners in which a relatively wide carrier strip of kraft paper or a textile fabric is secured by adhesive to a pair of relatively narrow reinforcing strips of sheet metal which are preferably about 0.015 inch thick and spaced apart about a sixteenth of an inch. The Perna product may be folded to a right angle shape along a longitudinal folding line extending through the space between the reinforcing strips. When so folded the carrier strip bends over the void between the reinforcing strips and so the carrier strip is the only support at the corner.

U.S. Pat. No. 3,109,207 (Cooper) aims to provide a lighter and cheaper corner reinforcing strip for drywall corners. This reinforcing strip has a fabric strip fixed by adhesive between two paper tapes of different widths. A central length of relatively rigid wire is held by adhesive between the fabric strip and the wider of the two tapes. When the Cooper reinforcing strip is bent to a right angel configuration with the wire at the corner and the wider paper tape at the outside of the corner, the outer half of the wire and the adjoining portion of the wider tape form a corner rib. The Cooper product is preferably bent to the angle shape during the manufacturing of the product. However, the patent indicates that the product may be merchandised in a flat condition and bent later.

Although the above-described corner reinforcing strips have been known for over 35 years they and the remaining prior art have not sparked the development of an adjustable tape-on corner trim strip having a well-reinforced corner rib and which is economical to produce.

SUMMARY OF THE INVENTION

The present invention fills the long-felt need for such an adjustable corner trim strip by providing a pair of parallel relatively stiff core strips separated by a gap which receives a flexible bead such as a cord. A paper tape covers the core strips and bead and together with the bead forms a corner rib. The paper tape is bonded by a suitable adhesive to the core strips and the flexible bead so that the corner strip is laterally flexible along the bead to fit various drywall corner angles.

DETAILED DESCRIPTION OF THE INVENTION

Figure 1:
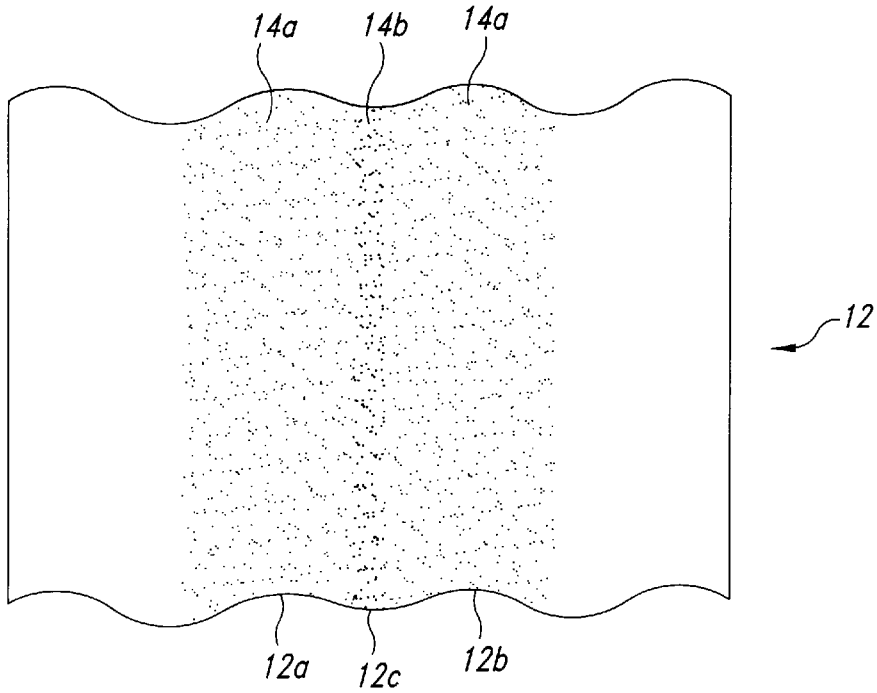
FIG. 1 is a plan view of the cover strip part of the trim strip after application of adhesive.
Figure 2:
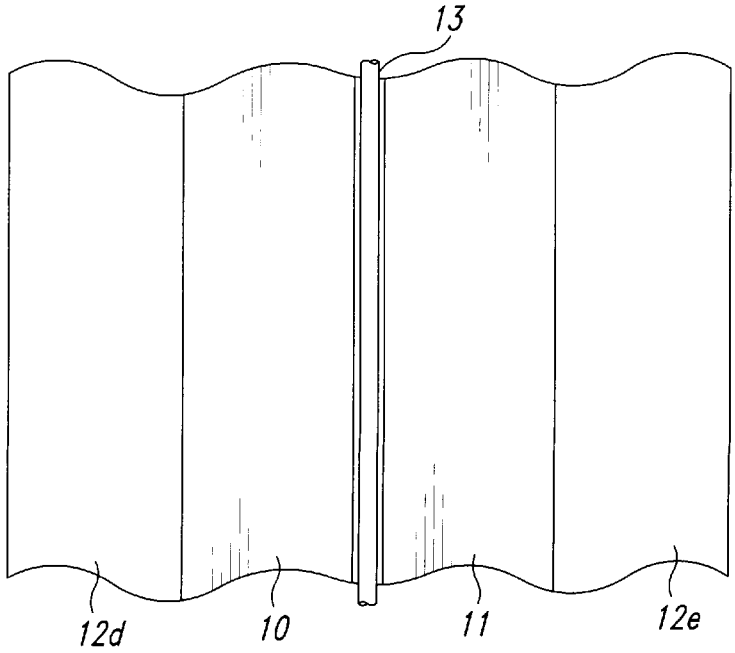
FIG. 2 is a plan view of the trim strip after application of the core strips and center bead to the cover strip.

Referring to the drawings, it is seen that the corner trim strip of the present invention comprises two core strips 10–11, an outer cover strip 12, a bead 13, and adhesive 14. The core strips 10–11 are preferably galvanized steel strips having a thickness between about 0.010 and 0.014 inches, and may also be formed of aluminum or a suitable plastic. The cover strip 12 is preferably 70 to 90 pound bleached kraft paper like that commonly used for wallboard joint tape. Preferably the bead 13 is a braided cord of synthetic fibers such as nylon, or a tightly twisted polyester or paper cord, and may have a diameter about 0.075 inches. Although not preferred, the bead 13 can be formed of flexible acrylic, styrene, or polyvinyl chloride plastic material or the like. The adhesive 14 is preferably a suitable thermoplastic hot melt adhesive having flexibility when hardened. Typically, the core strips will be about 0.75 inches wide and the cover strip 12 will have a width of about three inches. A central portion of the cover strip may be provided with a protective coating as described in U.S. Pat. No. 5,131,198.

Figure 3:
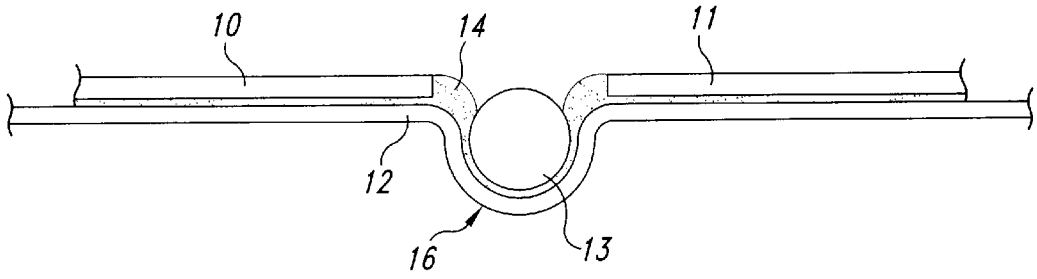
FIG. 3 is a detail end view of the elbow joint portion of the trim strip when the core strips are coplanar and with the thickness of the components exaggerated.
Figure 4:
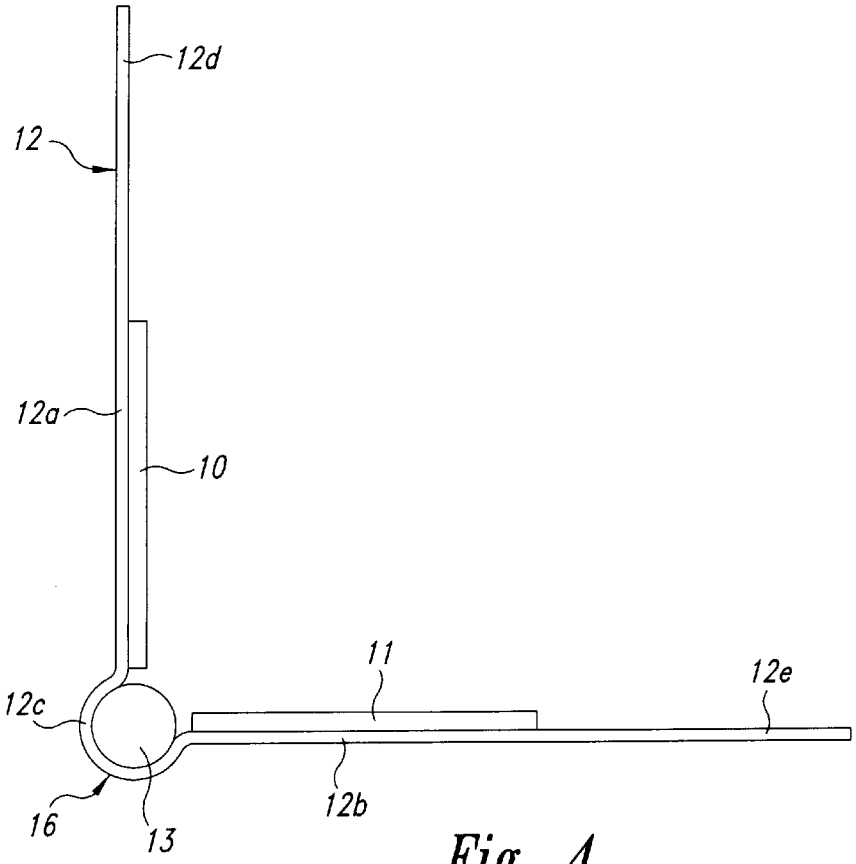
FIG. 4 is an end view of the finished trim strip with the thickness of the components exaggerated and without the adhesive being shown.

The steps practiced in producing the trim strips will now be described. The cover strip 12 is drawn from a reel of paper stock to move along a linear travel path. As indicated in FIG. 1, a coating 14 of adhesive is applied in two intermediate bands 12*a*–12*b* (FIG. 1) on the cover strip corresponding in width to the width of the core strips 10–11, and a thicker coating 14*a* of adhesive is applied to a center band 12*c* having a width of about 0.125 inches. This leaves two outer paper wings 12*d*, 12*e* free of adhesive. The adhesive coating 14*a* on the central band 12*c* is made thick enough to provide for good adherence of the cover strip to the bead 13 and to provide adhesive to fill the spaces between the inner edges of the core strips and the bead 13. After the adhesive has been applied and is partially set the cover strip moves over a support surface having a central groove. The support surface may constitute a slide surface or one or more rollers. The core strips 10–11 and the bead material 13 are then fed from reels and pressed downwardly by pressure rolls against the adhesive on the cover strip. The downward pressure on the bead 13 is concentrated to an extent necessary to press the bead 13 and an underlying center portion 12*c* of the cover strip into the groove on the support surface to form a rib 16. The top of the bead 13 is then substantially at the same level as the upper surfaces of the core strips 10–11 as shown in FIG. 3. Before the adhesive has fully set the core strip runs through a series of forming rolls to laterally bend the corner trim from a planar state to a preset dihedral angle of about 90 degrees with the bead as the apex as indicated in FIG. 4. Completion of drying of the adhesive is then preferably accomplished with the corner trim bent at this preset angle while it travels through a drying tunnel. The corner trim can then be cut to length for packaging.

When the adhesive has fully set the corner trim tends to assume the preset included dihedral angle of about 90 degrees. The joint at the bead 13 is flexible and act as a hinge in the sense that the core strips 10–11 can be easily laterally moved to narrower or wider dihedral angles to fit a variety of drywall corner angles without lateral bending of the core strips. Instead, the hinging action occurs in the narrow areas of the cover strip 12 between the bead 13 and the adjacent longitudinal side edges of the core strips and does not disturb the corner rib 16 of the trim strip so that regardless of the size of the dihedral angle the corner rib can serve as an abutment for joint cement dressed over the corner strip after it has been applied to a drywall corner in the conventional manner.

Although the invention has been illustrated as applied to a tape-on type of corner trim, it will be understood that the paper wing portions of the corner bead can be eliminated or narrowed and doubled back over the outer longitudinal edges of the core strips 10–11 to form a type of nail-on corner trim in which the fasteners are driven through both the paper cover strip and the core strips.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An adjustable angle trim, comprising:

two parallel metal or plastic core strips spaced apart by a gap and having inner and outer faces;

a flexible bead along said gap and projecting outwardly along its length from said strips;

a paper layer bonded by adhesive to said outer faces of said core strips and to said bead, said paper layer and said bead forming an outer rib, said core strips and the portions of said paper layer which is bonded thereto being swingable relative to said cord without lateral bending of said core strips between a position whereat the strips are coplanar and a position whereat the inner faces of the strips form an acute dihedral angle.

2. An adjustable angle trim according to claim 1 in which said paper layer covers said outer faces of said core strips and extends laterally beyond said core strips as wings.

3. An adjustable angle trim according to claim 1 in which said rib has a height greater than the combined thickness of said paper layer and one of said strips.

4. An adjustable angle trim according to claim 1 in which said adhesive is a thermoplastic hot melt adhesive.

5. An adjustable angle trim according to claim 1 in which said bead is a cord.

6. An adjustable angle trim according to claim 5 in which said cord is a tightly twisted cord.

7. An adjustable angle trim according to claim 5 in which said cord is a braided cord.

8. An adjustable angle trim, comprising:

an elongated paper layer having a central longitudinal portion, two outer longitudinal portions, and two intermediate longitudinal portions between and parallel to said central portion and said outer portions;

two metal or plastic strips overlying said intermediate portions only and having inner and outer faces;

a flexible cord overlying a central part of said central portion, and together with said central portion forming an outer longitudinal rib; and a layer of adhesive bonding said paper layer to said outer faces of said core strips and to said cord and permitting said core strips and related portions of said paper layer to be moved relative to one another and relative to said rib within a wide range of included angles between said strips without laterally bending of said core strips.

9. An adjustable angle trim, comprising:

two parallel metal or plastic strips spaced apart and having outer and inner faces;

a paper layer covering said outer faces and having a central portion between said strip looping outwardly to form a rib portion;

a flexible bead positioned within said rib portion and together therewith forming a rib; and adhesive bonding said paper layer to said outer faces and to said bead, said adhesive retaining said bead in said rib portion and permitting said strips and related portions of said paper layer to be swung relative to said rib within a wide range of included angles between said inner faces of the strips.

10. An adjustable angle trim according to claim 9 in which said bead is a cord.

11. An adjustable angle trim according to claim 9 in which said paper layer extends as wings laterally beyond said core strips.

* * * * *

UNITED STATES PATENT AND TRADEMARK OFFICE

CERTIFICATE OF CORRECTION

PATENT NO. : 6,223,486 B1
DATED : May 1, 2001
INVENTOR(S) : Wesley H. Dunham

It is certified that error appears in the above-identified patent and that said Letters Patent is hereby corrected as shown below:

Column 1,
Line 66, “to a right angel” should read -- to a right angle --.

Column 2,
Line 64, “thicker coating 14*a*” should read -- thicker coating 14*b* --.
Line 67, “adhesive coating 14*a*” should read -- adhesive coating 14*b* --.

Column 3,
Line 26, “flexible and act” should read -- flexible and acts --.

Column 4,
Line 3, “to said cord without” should read -- to said bead without --.

Signed and Sealed this

Eighth Day of October, 2002

*Attest:*

*Attesting Officer*

JAMES E. ROGAN
*Director of the United States Patent and Trademark Office*